US006105207A

United States Patent [19]

Muller

[11] Patent Number: 6,105,207

[45] Date of Patent: Aug. 22, 2000

[54] VACUUM CLEANER NOZZLE

[76] Inventor: Albert F. Muller, 15002 Torry Pines Rd., Houston, Tex. 77062

[21] Appl. No.: 09/270,345

[22] Filed: Mar. 16, 1999

[51] Int. Cl.[7] ..... A47L 9/02

[52] U.S. Cl. ..... 15/415.1; 15/420; 15/421

[58] Field of Search ..... 15/415.1, 420, 15/421

[56] References Cited

U.S. PATENT DOCUMENTS

| | | | |
|---|---|---|---|
| 3,550,183 | 12/1970 | Wolf | 15/420 |
| 3,678,534 | 7/1972 | Hilbig | 15/420 |
| 4,701,975 | 10/1987 | Hampton et al. | 15/420 |
| 4,989,294 | 2/1991 | Fischer | 15/415.1 |
| 5,063,635 | 11/1991 | Ishii et al. | 15/420 |
| 5,347,679 | 9/1994 | Saunders et al. | 15/420 |
| 5,497,532 | 3/1996 | Glatz | 15/415.1 |
| 5,987,700 | 11/1999 | Edlund | 15/420 |

*Primary Examiner*—Theresa T. Snider
*Attorney, Agent, or Firm*—Kenneth A. Roddy

[57] ABSTRACT

A vacuum nozzle adapted for use on a working surface has a generally rectangular main body portion with a top surface, a bottom surface, an outer periphery, and a central aperture through the main body portion for connection to a vacuum hose connected to a vacuum source. The main body portion may be slightly concave or flat. Spacers on the bottom surface support the main body portion above a surface to be cleaned at a predetermined height. The size and shape of the bottom surface, and its height above the surface to be cleaned are designed to draw air between the surface to be cleaned and the bottom surface of the nozzle at a substantially uniform velocity which is proportional to the inflow velocity of the vacuum hose connected with the nozzle, and to maintain little or no difference in static pressure between the air under the nozzle and the static pressure of the air above the nozzle.

14 Claims, 6 Drawing Sheets

VACUUM CLEANER NOZZLE

BACKGROUND OF THE INVENTION

1. Field of the Invention

This invention relates generally to vacuum cleaner nozzles, and more particularly to a generally rectangular vacuum cleaner nozzle having a slightly concave or flat main body portion with a central exhaust aperture for connection with a vacuum hose wherein the main body portion is maintained a predetermined distance above a flat surface to be cleaned and is configured to draw air between the surface to be cleaned and the bottom surface of the nozzle at a substantially uniform velocity which is proportional to the inflow velocity of the vacuum hose, and to maintain little or no difference in static pressure between the air under the nozzle and the static pressure of the air above the nozzle.

2. Brief Description of the Prior Art

A common problem with commercially available vacuum cleaner nozzles for heavy duty use, such as those used with a "Shop-Vac", is that they tend to grab the surface being vacuumed, for example when attempting to vacuum leaves off of a patio. The present vacuum cleaner nozzle has a novel configuration that was developed as result of careful testing of various prototypes.

Early testing was carried out using a board not much larger than the large diameter handheld flexible hose of a homebuilt garden vacuum. The board was equipped with 4 small full-swiveling wheels serving as spacers to place the board a distance above the ground and for ease of guidance and manipulation. It was discovered that the board itself was improving the vacuum performance of the system.

Subsequent use in my woodworking and metalworking shop revealed many problems including: rapid wear of the four supporting knobs or feet, difficulty in replacing those feet, their susceptibility to being broken off on irregular surfaces, inability to determine whether short wires, BB's, glass, or other dangerous objects had been picked up or moved to an undetermined location.

Another problem was the lower rate of flow at the corners than other locations. Early tests were made primarily by visual observations rather than using airflow instruments, such as commercially available normal and ultra-light aircraft speed indicators, since these types of instruments were ineffective in the limited space and airflow velocity of the vacuum cleaner. However, later qualitative practical testing was carried out to test the effectiveness and relative velocities using BB's and iron filings as the materials to be picked up and using an aircraft altimeter to measure the static pressure about a flush mounted probe as the nozzle was moved about it.

These tests revealed that conventional prior art vacuum cleaner nozzles are designed such that a very high velocity exists at their outer edges, but the larger volumes downstream of the edges act as a large volume plenum chamber in which the actual velocity is diminished, thus reducing the ability to move debris to the pick-up point of the nozzle.

The aerodynamic design of the present invention produces a uniform velocity from all points into the pickup point (the central aperture which is connected with the hose). This may be demonstrated by sprinkling coarse iron filings on a hard floor, placing the nozzle over them and observing the flow of the filings when the vacuum is applied. After the flow has stabilized for a couple of seconds the filings are gone from beneath the nozzle and for about ¼ inch outside of the nozzle perimeter. Similar testing shows that small BB's and shotgun shot perform similarly.

Commercially available nozzles of the prior art are unable to effectively remove dense objects such as BB's and shot, etc. Instead, they move debris from the high velocity area near their outer edges, but leave it collected under the nozzle in the low velocity areas of the pickup point (the central aperture which is connected with the hose). Typically, prior art nozzles are designed to achieve a high pressure differential with the resultant increase in air speed near their perimeters but at a loss of air speed inwardly from their perimeter brushes and walls. As a result, they can suffer loss of air speed and flow rate if the operator does not properly control the position of the nozzle.

The present invention is distinguished over the prior art in general by a vacuum nozzle adapted for use on a working surface that has a generally rectangular main body portion with a top surface, a bottom surface, an outer periphery, and a central aperture through the main body portion for connection to a vacuum hose connected to a vacuum source. The main body portion may be slightly concave or flat. Spacers on the bottom surface support the main body portion above a surface to be cleaned at a predetermined height. The size and shape of the bottom surface, and its height above the surface to be cleaned are designed to draw air between the surface to be cleaned and the bottom surface of the nozzle at a substantially uniform velocity which is proportional to the inflow velocity of the vacuum hose connected with the nozzle, and to maintain little or no difference in static pressure between the air under the nozzle and the static pressure of the air above the nozzle.

SUMMARY OF THE INVENTION

It is therefore an object of the present invention to provide a nozzle that has a main body portion that is spaced above the surface to be cleaned at a fixed minimum distance so as to form a space therebetween in which the static pressure between the nozzle and the surface to be cleaned is substantially the same as ambient static pressure except in the immediate vicinity of the hose connection where the airflow is turning to the vertical.

It is another object of this invention to provide a nozzle that has a uniform velocity beneath the nozzle in proportion to the inflow velocity into the unrestricted vacuum hose and handle unit.

Another object of this invention is to provide a nozzle that may be used on the handle portions of suction hoses of vacuum cleaners for effectively removing undesirable solid, particulate, or liquid debris, such as threads, dust, sawdust, chemicals, water, straps, and difficult to remove litter that is more dense and streamlined, such as BB', bolts, nails, nuts and other loose objects commonly found on floors, sidewalks, workbenches, decks, etc.

Another object of this invention is to provide a nozzle that can be lifted and its central exhaust aperture placed over selected objects so as to ingest objects of complex shapes and the largest object that can reliably pass through the flexible suction hose, its joints, the rigid handle, and other parts of the vacuum cleaner's entrainment system.

Another object of this invention is to provide a nozzle that can be easily lifted to place it over an object too large to enter its exhaust aperture and allow the suction to lock on the object so that it can be lifted to the user's hand or disposal location and eliminates the necessity of the user to bend over to pick up such objects.

Another object of this invention is to provide a nozzle having a minimum height profile that it to be used to vacuum under very low obstructions.

Another object of this invention is to provide a nozzle that can be used to vacuum close to blocks, walls, boards, etc., by pressing any nozzle side against such objects, and sliding it along the intersection of the object and the floor.

Another object of this invention is to provide a nozzle that may be formed of transparent material to allow the user to view the action of the debris under the nozzle to assure the desired cleaning action is attained.

Another object of this invention is to provide a nozzle that facilitates cleaning cracks and ridges in a floor by forming a maze of three dimensions in which the velocity of the air entering the suction hose can entrain debris.

A further object of this invention is to provide a nozzle composed of few parts which are held together by a tapered press fit so that the unit may be quickly assembled and disassembled without the use of tools.

A still further object of this invention is to provide a nozzle that is simple in construction, inexpensive to manufacture, and rugged and reliable in operation.

Other objects of the invention will become apparent from time to time throughout the specification and claims as hereinafter related.

The above noted objects and other objects of the invention are accomplished by a vacuum nozzle adapted for use on a working surface that has a generally rectangular main body portion with a top surface, a bottom surface, an outer periphery, and a central aperture through the main body portion for connection to a vacuum hose connected to a vacuum source. The main body portion may be slightly concave or flat. Spacers on the bottom surface support the main body portion above a surface to be cleaned at a predetermined height. The size and shape of the bottom surface, and its height above the surface to be cleaned are designed to draw air between the surface to be cleaned and the bottom surface of the nozzle at a substantially uniform velocity which is proportional to the inflow velocity of the vacuum hose connected with the nozzle, and to maintain little or no difference in static pressure between the air under the nozzle and the static pressure of the air above the nozzle.

DESCRIPTION OF THE PREFERRED EMBODIMENTS

Figure 1:
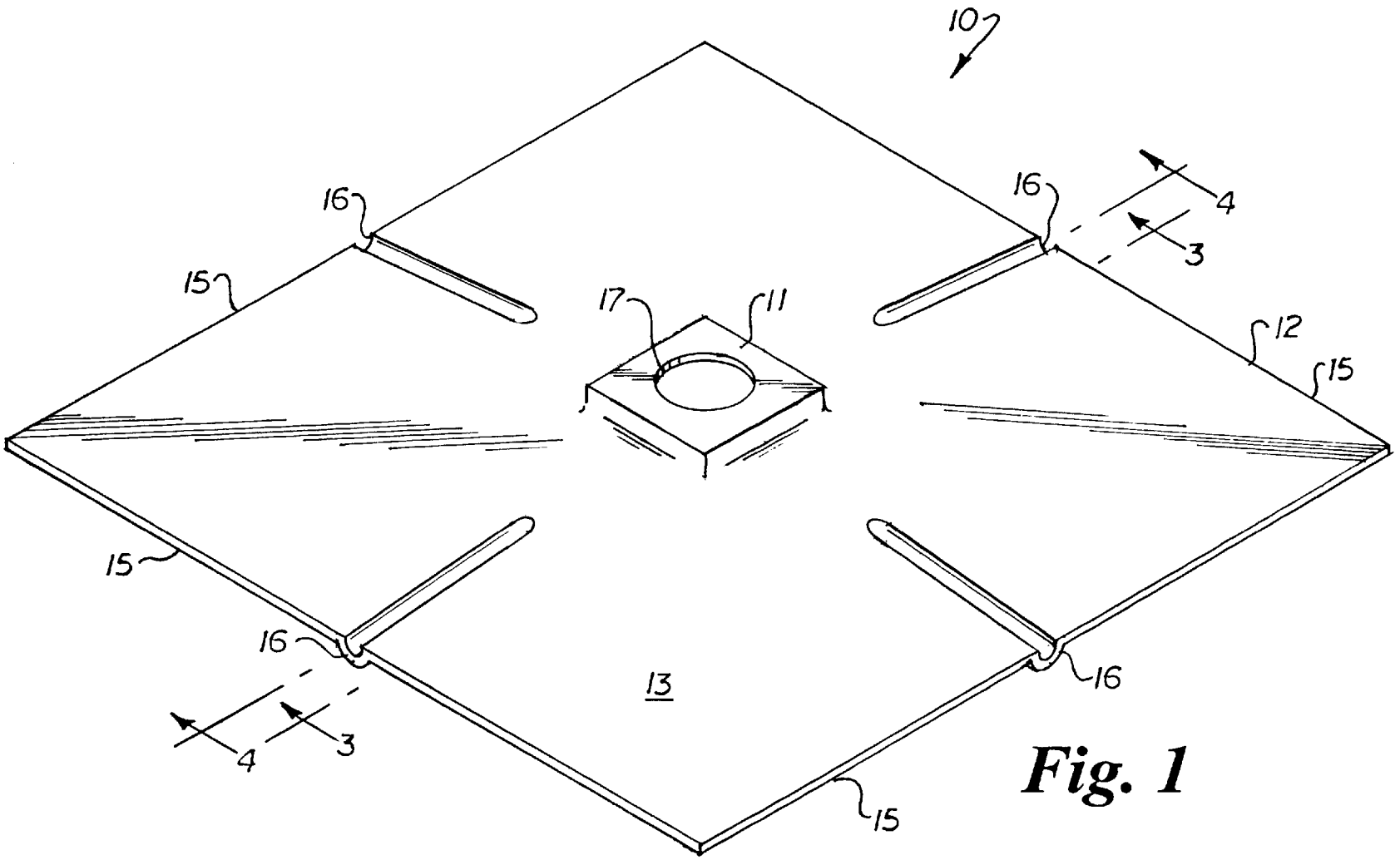
FIG. 1 is a perspective view of a slightly concave nozzle in accordance with the present invention, as seen from the top.
Figure 2:
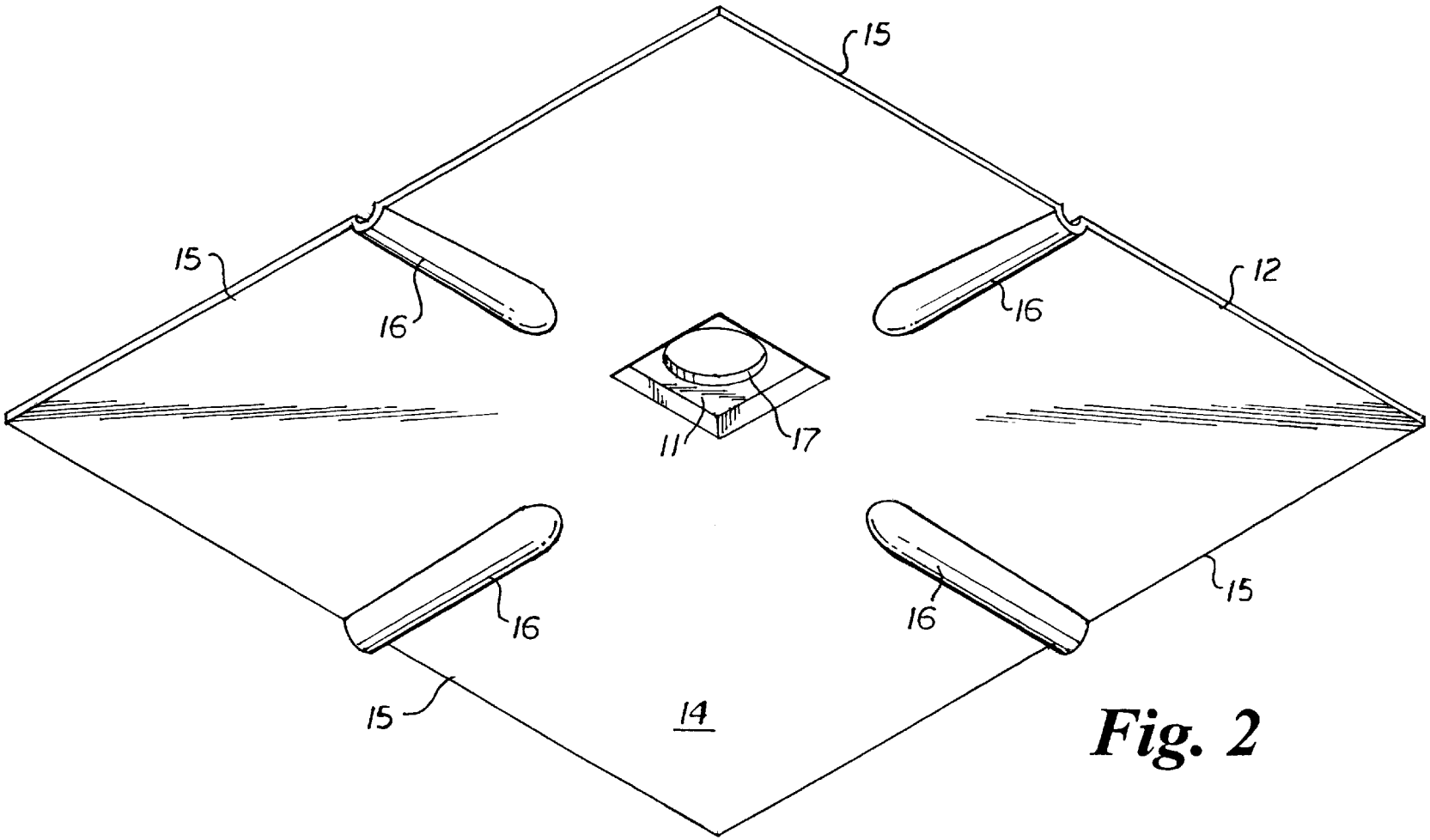
FIG. 2 is a perspective view of the slightly concave nozzle, as seen from the bottom.

Referring to the drawings by numerals of reference, there is shown in FIGS. 1 through 4, a slightly concave nozzle 10 in accordance with the preferred embodiment of the present invention. The nozzle 10 is a generally square or rectangular configuration having a central raised flat portion 11 configured for attaching a swivel assembly. The swivel assembly is commercially available and is not part of the invention and therefore not shown.

The nozzle 10 has a main body portion 12 of uniform thickness having a top surface 13, a bottom surface 14, and opposed straight sides 15. The main body portion 12 is of greater height at its center than its outer periphery to form a slightly concave configuration. The flat raised portion 11 blends smoothly into the main body portion 12. A series of elongate concave spacer protrusions 16 are formed in the surface of the main body portion and extend radially inward a distance from the center of the outer sides 15 of the main body portion.

Figure 3:
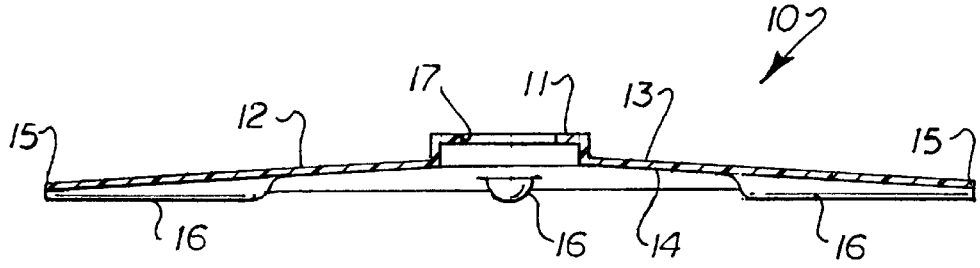
FIG. 3 is a cross sectional view through the slightly concave nozzle taken along line 3—3 of FIG. 1.
Figure 4:
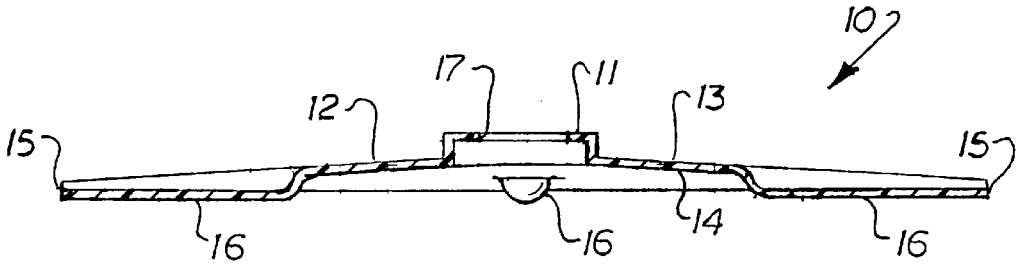
FIG. 4 is a cross sectional view through the slightly concave nozzle taken along line 4—4 of FIG. 1.
Figure 5:
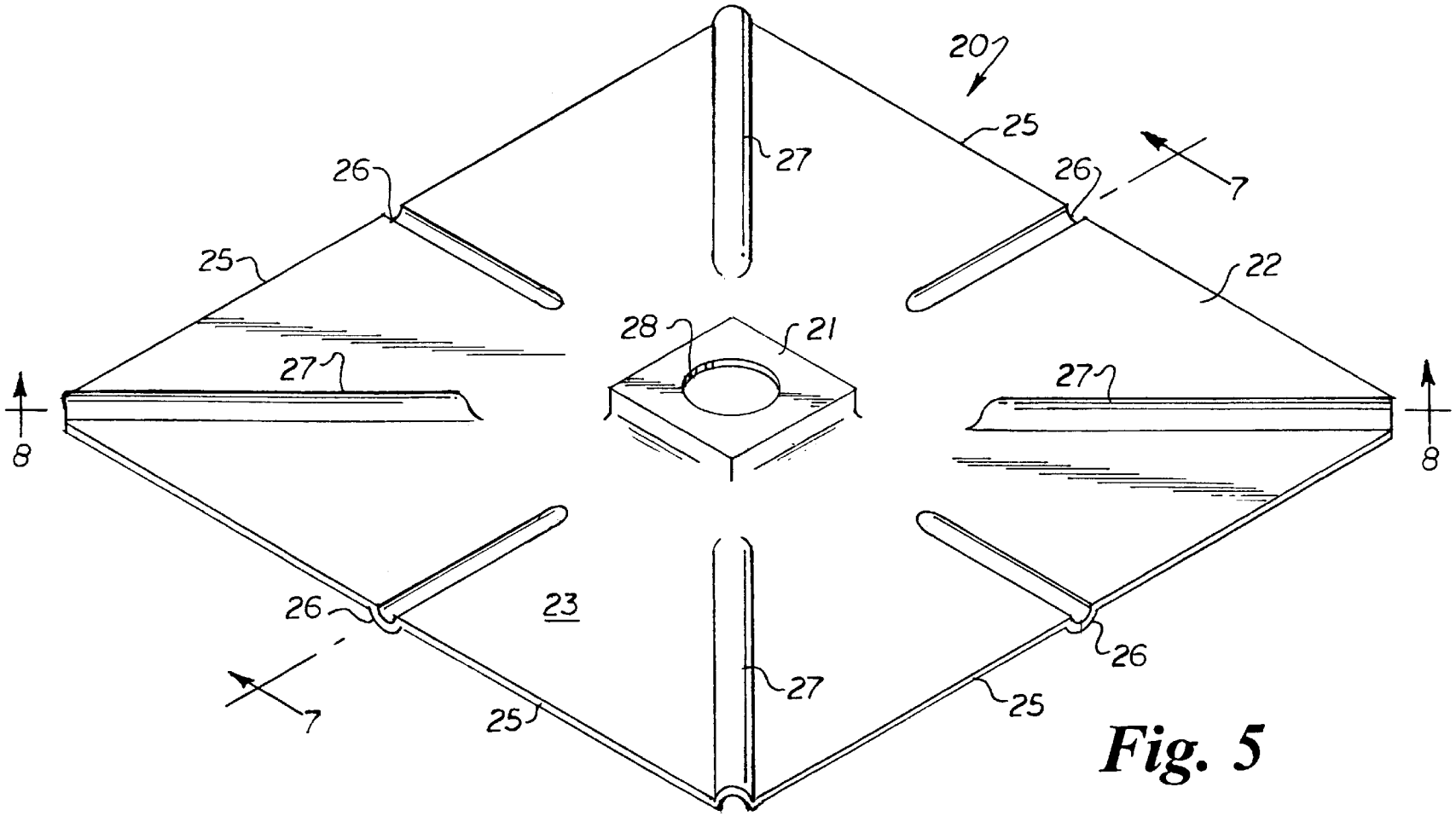
FIG. 5 is a perspective view of a generally flat nozzle embodiment in accordance with the present invention, as seen from the top.
Figure 6:
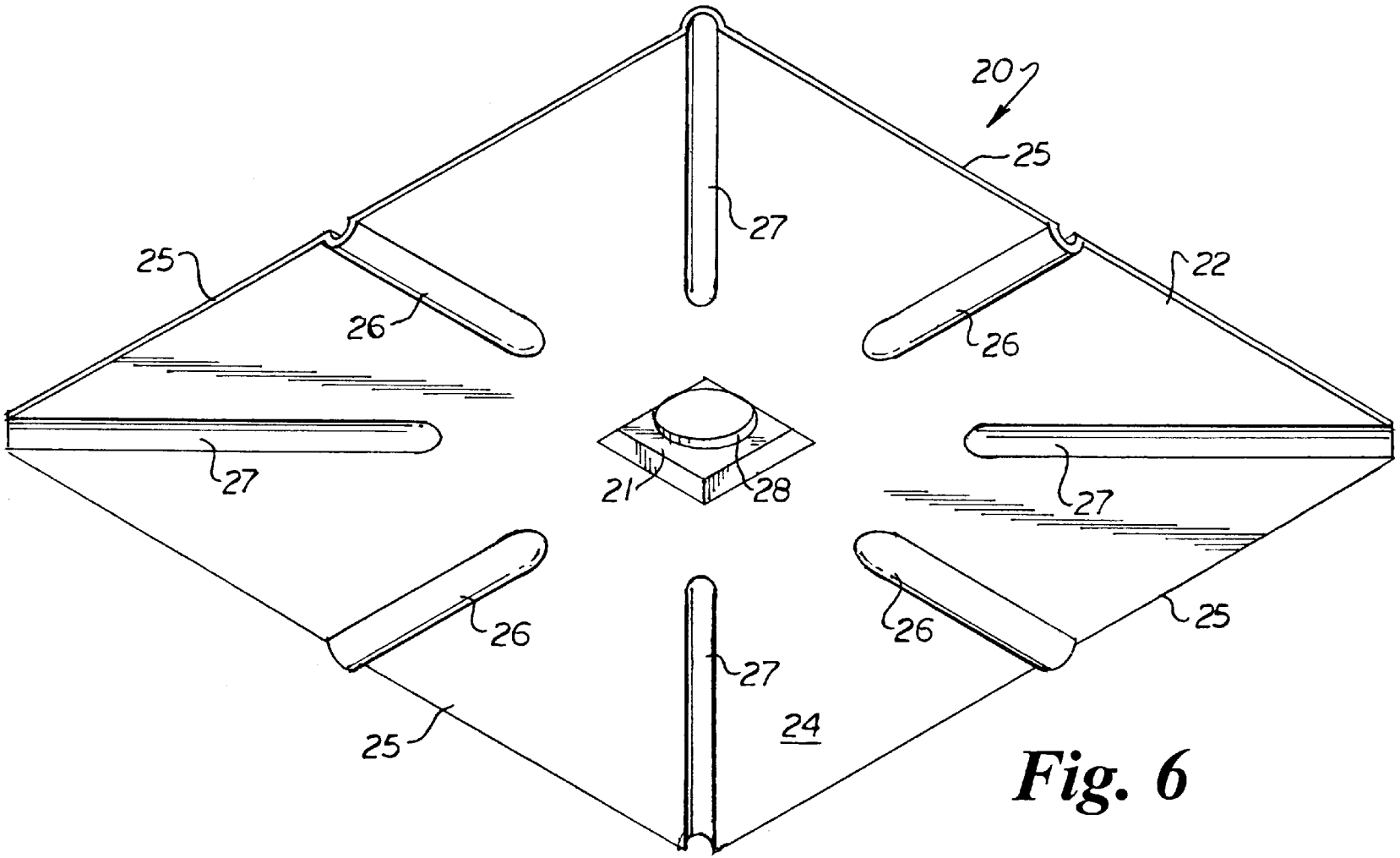
FIG. 6 is a perspective view of the generally flat nozzle, as seen from the bottom.

As best seen in cross section in FIGS. 3 and 4, the concave spacer protrusions 16 extend downwardly from the bottom surface 14 of the main body portion 12. The bottom of the protrusions 16 extend inwardly along a horizontal plane and their upper portions blend into the concave main body portion 12, and serve as legs to space the concave bottom surface 14 of the main body portion a predetermined distance above the surface to be cleaned.

The central raised flat portion 11 is elevated a short distance above the main body portion 12 and has a central hole 17 into which a commercially available swivel assembly (not shown) is mounted. The swivel assembly is attached to the tube at the end of a conventional commercially available vacuum cleaner hose (not shown). The air flows beneath the main body portion 12 and enters the vacuum hose through the hole 17 and swivel assembly.

Preferably, the nozzle 10 is formed of a suitable lightweight rigid material, such as a moldable metal, composite, or plastic material compatible with the chemical nature of the material it is to be in contact with it. The configuration of the nozzle lends itself well to being formed by injection molding, vacuum forming, thermosetting, or a stamping process. The nozzle may also be formed of transparent or translucent material to allow the user to view the action of the debris under the nozzle to assure that the desired cleaning action is attained.

The nozzle 10 is sized and shaped and supported at a height above the surface to be cleaned to draw air between the underside of the nozzle and the surface to be cleaned at a substantially uniform velocity which is proportional to the inflow velocity of the vacuum hose connected with the nozzle, and to maintain little or no difference in static pressure between the air under the nozzle and the static pressure above the nozzle.

This is accomplished by selecting the fraction of the velocity that is desired and then configuring the underside of the nozzle accordingly. Typically, the equation for this is:

$$\dot{m}_1=\dot{m}_2=\dot{m}_i=\rho A_i V_i$$

Where $\dot{m}_1$=mass airflow into the unrestricted hose, $\dot{m}_2$=mass airflow under the perimeter of the nozzle, $\dot{m}_i$=mass airflow through any imaginary square wall under the nozzle whose sides are parallel to the nozzle's outer perimeter, $\rho$(rho)=density of air in slugs/ft$^3$, and $A_i$=area of the wall at a specified lateral distance "i" from the center of the nozzle.

Thus, the elevation of the nozzle's lower profile is determined by the equation:

$$\dot{m}_1=\dot{m}_i=\rho A_i V_I$$

$$A_i=D^2/4$$

$$A_i=8S_iH_I$$

When $V_i/V_1=0.2$, and S=5" and D=1", $H=\pi D^2(V_i/V_1)/8SH$, then

H=0.355" =maximum height at 1.5" from the center.

Where the normal diameter of the vacuum hose is practically 1" in diameter, S=the distance from the center of the nozzle; therefore, the height of the outer perimeter of the nozzle is about 0.1" for most shop vacuum cleaners; the flow will be unchoked under the nozzle and the mass flow rate will be the same as the bare suction tube.

In this subsonic flow field, the density and mass flow rate remain constant. Thus, the velocity at any given point under the nozzle is dependent only upon the height of the nozzle above the floor surface. It is desirable to have as nearly constant velocity as possible and therefore the nozzle is symmetrical. From experience, it appears that a velocity at the edge and under the nozzle in the range of from about 10% to about 30% of the suction hose or tube velocity would be suitable, the most desired velocity at the edge and under the nozzle being from about 15% to about 20% of the suction hose or tube velocity.

Referring now to the drawings by numerals of reference, there is shown in FIGS. 5 through 8, a generally flat nozzle 20 in accordance with another preferred embodiment of the present invention. The nozzle 20 is a generally square or rectangular configuration having a central raised flat portion 21 configured for attaching a swivel assembly. The swivel assembly is commercially available and is not part of the invention and therefore not shown.

The nozzle 20 has a main body portion 22 of uniform thickness having a top surface 23, a bottom surface 24, and opposed straight sides 25. The flat raised portion 21 blends smoothly into the main body portion 22. A series of elongate concave spacer protrusions 26 are formed in the surface of the main body portion and extend radially inward a distance from the center of the outer sides 26 of the main body portion. A series of elongate convex air flow channels 27 are formed in the surface of the main body portion and extend radially inward a distance from the corners of the main body portion.

Figure 7:
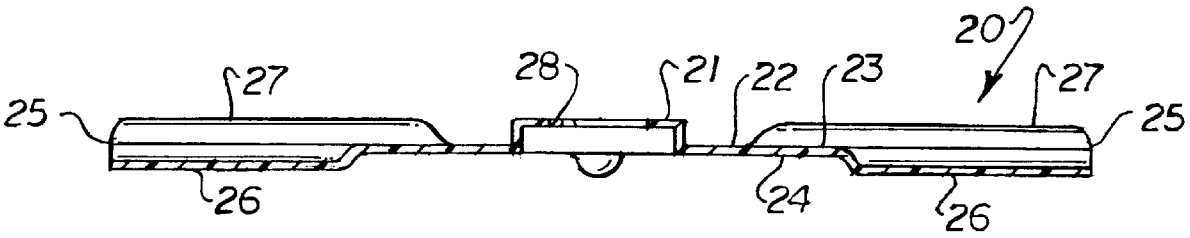
FIG. 7 is a cross sectional view through the generally flat nozzle taken along line 7—7 of FIG. 5.

As best seen in cross section in FIG. 7, the concave spacer protrusions 26 extend downwardly from the bottom surface 24 of the main body 22. The bottom of the protrusions 26 extend inwardly along a horizontal plane in parallel spaced relation to the flat main body portion, and serve as legs to space the flat bottom surface 24 of the main body portion a predetermined distance above the surface to be cleaned.

Figure 8:
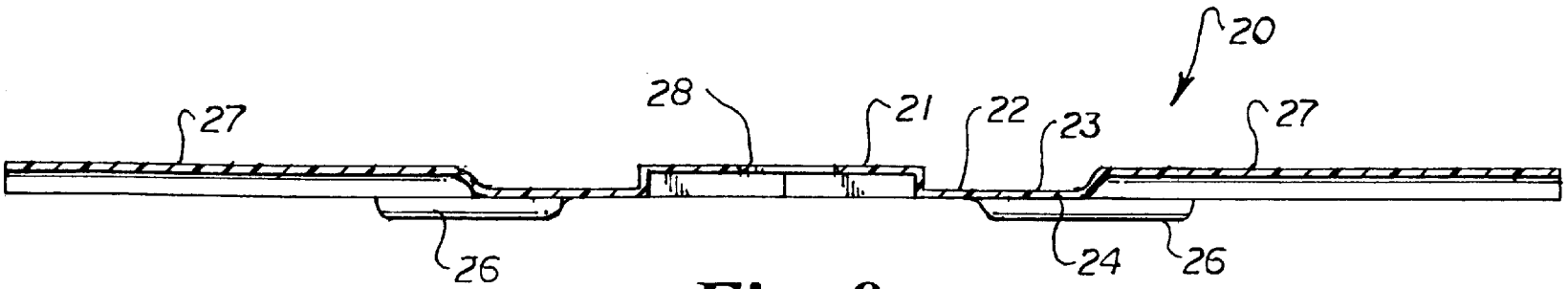
FIG. 8 is a cross sectional view through the generally flat nozzle taken along line 8—8 of FIG. 5.

As best seen in FIG. 8, the convex air flow channels 27 extend upwardly from the flat bottom surface 24 of the main body portion 22, and serve as conduits for drawing air from the exterior into the underside of the nozzle.

As with the previously described embodiment, the central raised flat portion 21 is elevated a short distance above the main body portion 22 and has a central hole 28 into which a commercially available swivel assembly (not shown) is mounted. The swivel assembly is attached to the tube at the end of a conventional commercially available vacuum cleaner hose (not shown). The air flows beneath the main body portion 22 and enters the vacuum hose through the hole 28 and swivel assembly.

Preferably, the nozzle 20 is formed of a suitable lightweight rigid material, such as a moldable metal, composite, or plastic material compatible with the chemical nature of the material it is to be in contact with it. The configuration of the nozzle lends itself well to being formed by injection molding, vacuum forming, thermosetting, or a stamping process. The nozzle may also be formed of transparent or translucent material to allow the user to view the action of the debris under the nozzle to assure that the desired cleaning action is attained.

The nozzle 20 is sized and shaped and supported at a predetermined height above the surface to be cleaned to draw air between the underside of the nozzle and the surface to be cleaned, and the air flow channels 27 are sized relative to the height of the bottom surface 24 above the surface to be cleaned such that the air drawn through the air flow channels and the air drawn between the surface to be cleaned and the bottom surface is at a substantially uniform velocity proportional to the inflow velocity of air into the vacuum hose connected with the nozzle. and such that the static pressure of the air drawn between the surface to be cleaned and the bottom surface is approximately equal to the static pressure of the air above the nozzle.

While this invention has been described fully and completely with special emphasis upon preferred embodiments, it should be understood that within the scope of the appended claims the invention may be practiced otherwise than as specifically described herein.

What is claimed is:

1. A vacuum nozzle adapted for use on a working surface comprising:

a main body portion having a top surface, a bottom surface and an outer periphery;

a central aperture through said main body portion and said bottom surface for connection in fluid communication with a vacuum hose connected to a vacuum source; and spacer means on said bottom surface adapted to be supported on a surface to be cleaned and sized to position said bottom surface a predetermined height above the surface to be cleaned;

said bottom surface sized and shaped and disposed at a height above the surface to be cleaned to draw air between said surface to be cleaned and said bottom surface at a substantially uniform velocity proportional to the inflow velocity of air into the vacuum hose connected with said aperture, and the static pressure of the air drawn between said surface to be cleaned and said bottom surface is approximately equal to the static pressure of the air above said nozzle.

2. The nozzle according to claim 1, wherein said main body portion is a generally rectangular configuration.

3. The nozzle according to claim 2, wherein said main body portion is a generally square configuration.

4. The nozzle according to claim 1, wherein said bottom surface is a generally flat planar surface.

5. The nozzle according to claim 4, further comprising:

a plurality of elongate air flow passageways formed in said bottom surface extending radially inward a distance from said outer periphery for drawing air from the exterior into said nozzle beneath said bottom surface.

6. A vacuum nozzle adapted for use on a working surface comprising:

a main body portion having a top surface, a bottom surface and an outer periphery;

a central aperture through said main body portion and said bottom surface for connection in fluid communication with a vacuum hose connected to a vacuum source, and a plurality of elongate narrow rounded protrusions on said bottom surface extending radially inward a distance from said outer periphery adapted to be supported on a surface to be cleaned and sized to position said bottom surface a predetermined height above the surface to be cleaned;

said bottom surface sized and shaped and disposed at a height above the surface to be cleaned to draw air between said surface to be cleaned and said bottom surface at a substantially uniform velocity proportional to the inflow velocity of air into the vacuum hose connected with said aperture.

7. The nozzle according to claim 6, wherein said protrusions are concave depressions formed in said main body portion, said concave depressions in transverse cross section extending downwardly from said bottom surface.

8. A vacuum nozzle adapted for use on a working surface comprising:

a main body portion having a top surface, a bottom surface and an outer periphery;

a central aperture through said main body portion and said bottom surface for connection in fluid communication with a vacuum hose connected to a vacuum source; and spacer means on said bottom surface adapted to be supported on a surface to be cleaned and sized to position said bottom surface a predetermined height above the surface to be cleaned;

said bottom surface sized and shaped and disposed at a height above the surface to be cleaned to draw air between said surface to be cleaned and said bottom surface at a substantially uniform velocity of from about 10% to about 30% of the inflow velocity into the vacuum hose connected with said aperture.

9. A vacuum nozzle adapted for use on a working surface comprising:

a main body portion having a top surface, a bottom surface and an outer periphery said bottom surface having a generally concave configuration with a center portion at a height greater than the height of said outer periphery;

a central aperture through said main body portion and said bottom surface for connection in fluid communication with a vacuum hose connected to a vacuum source; and spacer means on said bottom surface adapted to be supported on a surface to be cleaned and sized to position said bottom surface a predetermined height above the surface to be cleaned;

said bottom surface sized and shaped and disposed at a height above the surface to be cleaned to draw air between said surface to be cleaned and said bottom surface at a substantially uniform velocity proportional to the inflow velocity of air into the vacuum hose connected with said aperture.

10. The nozzle according to claim 8, wherein said substantially uniform velocity of air drawn between said surface to be cleaned is determined by the equation:

$$\dot{m}_1=\dot{m}_2=\dot{m}_i=\rho A_i V_i$$

where $\dot{m}_1$=mass airflow into the vacuum hose connected with said aperture, $\dot{m}_2$=mass airflow under said periphery perimeter of said main body portion, $\dot{m}_i$=mass airflow through a theoretical square wall under the nozzle whose sides are parallel to said outer periphery, P =density of air in slugs/ft$^3$, and $A_i$=area of the theoretical wall at a specified lateral distance "i" from the center of said aperture.

11. The nozzle according to claim 10, wherein said height of said bottom surface above the surface to be cleaned is determined by the equation:

$$\dot{m}_1=\dot{m}_i=\rho A_i V_I$$

$$A_i=D^2/4$$

$$A_i=8S_iH_i$$

where D=the inside diameter of the hose, $S_i$=the distance of said outer periphery from the center of said main body, and $H_i$=the height of said bottom surface above the surface to be cleaned.

12. A vacuum nozzle adapted for use on a working surface comprising:

a main body portion having a top surface, a generally flat planar bottom surface, an outer periphery, and a plurality of elongate air flow passageways formed in said bottom surface extending radially inward a distance from said outer periphery for drawing air from the exterior into said nozzle beneath said bottom surface;

a central aperture through said main body portion and said bottom surface for connection in fluid communication with a vacuum hose connected to a vacuum source; and spacer means on said bottom surface adapted to be supported on a surface to be cleaned and sized to position said bottom surface a predetermined height above the surface to be cleaned;

said bottom surface sized and shaped and disposed at a height above the surface to be cleaned, and said air flow passageways sized relative to said height of said bottom surface above the surface to be cleaned such that the air drawn through said air flow passageways and the air drawn between said surface to be cleaned and said bottom surface is at a substantially uniform velocity proportional to the inflow velocity of air into the vacuum hose connected with said aperture.

13. The nozzle according to claim 12, wherein said air flow passageways are elongate channels formed in said bottom surface, said channels in transverse cross section extending upwardly from said bottom surface.

14. The nozzle according to claim 12, wherein said air flow passageways are sized and shaped relative to the size and shape of said bottom surface and said bottom surface is disposed at a height above the surface to be cleaned such that the static pressure of the air drawn between said surface to be cleaned and said bottom surface is approximately equal to the static pressure of the air above said nozzle.

* * * * *